US011282459B2

(12) United States Patent
Park et al.

(10) Patent No.: US 11,282,459 B2
(45) Date of Patent: Mar. 22, 2022

(54) DISPLAY APPARATUS AND METHOD OF DRIVING DISPLAY PANEL USING THE SAME

(71) Applicant: Samsung Display Co., Ltd., Yongin-Si (KR)

(72) Inventors: Sehyuk Park, Seongnam-si (KR); Hyojin Lee, Yongin-si (KR); Sangan Kwon, Cheonan-si (KR); Jinyoung Roh, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/914,163

(22) Filed: Jun. 26, 2020

(65) Prior Publication Data

US 2021/0020107 A1 Jan. 21, 2021

(30) Foreign Application Priority Data

Jul. 18, 2019 (KR) ..... 10-2019-0087239

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2320/0247* (2013.01); *G09G 2330/021* (2013.01)

(58) Field of Classification Search
CPC .. G09G 3/3233; G09G 3/3258; G09G 3/3291; G09G 2320/0247; G09G 2320/103; G09G 2330/021; G09G 5/18; G09G 3/36; G09G 3/3688; G09G 3/3677; G09G 3/3266; G09G 2340/0435
See application file for complete search history.

(56) References Cited

U.S. PATENT DOCUMENTS

2015/0228216 A1* 8/2015 Lee ..... G09G 3/20 345/691
2015/0340014 A1* 11/2015 Kim ..... G09G 5/10 345/212
2017/0018234 A1* 1/2017 Na ..... G09G 3/3406

FOREIGN PATENT DOCUMENTS

EP 2905770 A2 8/2015
KR 10-2013-0131162 A 12/2013
KR 10-2016-0080768 A 7/2016
KR 10-1814222 B1 1/2018

* cited by examiner

*Primary Examiner* — Xuemei Zheng
(74) *Attorney, Agent, or Firm* — Innovation Counsel LLP

(57) ABSTRACT

A display apparatus includes a display panel, a gate driver, a data driver and a driving controller. The display panel displays an image based on input image data. The gate driver outputs a gate signal to a gate line of the display panel. The data driver outputs a data voltage to a data line of the display panel. The driving controller is configured to control an operation of the gate driver and an operation of the data driver, to determine a driving mode of the display apparatus among one of a normal driving mode and a low frequency driving mode, and to determine a driving frequency of the display panel based on the input image data. The driving controller includes a flicker value storage configured to store flicker values for a part of grayscale values among all of grayscale values of the input image data.

16 Claims, 16 Drawing Sheets

FIG. 3

| STAGE | INPUT GRAYSCALE VALUE(8 bits) | FLICKER VALUE | FREQUENCY(Hz) |
|---|---|---|---|
| 1 | 0-3 | 0 | 1 |
| 2 | 4-7 | 0 | 1 |
| 3 | 8-11 | 40 | 2 |
| 4 | 12-15 | 80 | 5 |
| 5 | 16-19 | 120 | 10 |
| 6 | 20-23 | 160 | 30 |
| 7 | 24-27 | 200 | 60 |
| ⋮ | ⋮ | ⋮ | ⋮ |
| 60 | 236-239 | 0 | 1 |
| 61 | 240-243 | 0 | 1 |
| 62 | 244-247 | 0 | 1 |
| 63 | 248-251 | 0 | 1 |
| 64 | 252-255 | 0 | 1 |

FIG. 4

| STAGE | INPUT GRAYSCALE VALUE(10 bits) | FLICKER VALUE | FREQUENCY(Hz) |
|---|---|---|---|
| 1 | 0-15 | 0 | 1 |
| 2 | 16-31 | 0 | 1 |
| 3 | 32-47 | 40 | 2 |
| 4 | 48-63 | 80 | 5 |
| 5 | 64-79 | 120 | 10 |
| 6 | 80-95 | 160 | 30 |
| 7 | 96-111 | 200 | 60 |
| ⋮ | ⋮ | ⋮ | ⋮ |
| 60 | 944-959 | 0 | 1 |
| 61 | 960-975 | 0 | 1 |
| 62 | 976-991 | 0 | 1 |
| 63 | 992-1007 | 0 | 1 |
| 64 | 1008-1023 | 0 | 1 |

FIG. 6

| STAGE | INPUT GRAYSCALE VALUE(8 bits) | FLICKER VALUE | FREQUENCY(Hz) |
|---|---|---|---|
| 1 | 0-1 | 0 | 1 |
| 2 | 2-3 | 0 | 1 |
| 3 | 4-5 | 0 | 1 |
| 4 | 6-7 | 0 | 1 |
| 5 | 8-9 | 10 | 1 |
| 6 | 10-11 | 50 | 2 |
| 7 | 12-13 | 60 | 2 |
| 8 | 14-15 | 90 | 5 |
| 9 | 16-17 | 110 | 10 |
| 10 | 18-19 | 120 | 10 |
| 11 | 20-21 | 130 | 10 |
| 12 | 22-23 | 140 | 30 |
| 13 | 24-25 | 170 | 30 |
| 14 | 26-27 | 200 | 60 |
| ⋮ | ⋮ | ⋮ | ⋮ |
| 60 | 118-119 | 0 | 1 |
| 61 | 120-121 | 0 | 1 |
| 62 | 122-123 | 0 | 1 |
| 63 | 124-125 | 0 | 1 |
| 64 | 126-127 | 0 | 1 |

FIG. 8

| STAGE | INPUT GRAYSCALE VALUE(8 bits) | FLICKER VALUE | FREQUENCY(Hz) |
|---|---|---|---|
| 1 | 0 | 0 | 1 |
| 2 | 1 | 0 | 1 |
| 3 | 2 | 0 | 1 |
| 4 | 3 | 0 | 1 |
| 5 | 4 | 0 | 1 |
| 6 | 5 | 0 | 1 |
| 7 | 6 | 0 | 1 |
| 8 | 7 | 5 | 1 |
| 9 | 8 | 10 | 1 |
| 10 | 9 | 20 | 1 |
| 11 | 10 | 40 | 2 |
| 12 | 11 | 55 | 2 |
| ⋮ | ⋮ | ⋮ | ⋮ |
| 62 | 61 | 0 | 1 |
| 63 | 62 | 0 | 1 |
| 64 | 63 | 0 | 1 |

FIG. 9

| STAGE | INPUT GRAYSCALE VALUE(8 bits) | FLICKER VALUE | FREQUENCY(Hz) |
|---|---|---|---|
| 1 | 128-129 | 0 | 1 |
| 2 | 130-131 | 0 | 1 |
| 3 | 132-133 | 20 | 1 |
| 4 | 134-135 | 30 | 1 |
| 5 | 136-137 | 40 | 2 |
| 6 | 138-139 | 60 | 2 |
| 7 | 140-141 | 110 | 10 |
| 8 | 142-143 | 130 | 10 |
| 9 | 144-145 | 160 | 30 |
| 10 | 146-147 | 200 | 60 |
| 11 | 148-149 | 220 | 60 |
| 12 | 150-151 | 200 | 60 |
| ⋮ | ⋮ | ⋮ | ⋮ |
| 62 | 250-251 | 0 | 1 |
| 63 | 252-253 | 0 | 1 |
| 64 | 254-255 | 0 | 1 |

FIG. 10

| STAGE | INPUT GRAYSCALE VALUE(8 bits) | FLICKER VALUE | FREQUENCY(Hz) |
|---|---|---|---|
| 1 | 64-65 | 0 | 1 |
| 2 | 66-67 | 0 | 1 |
| 3 | 68-69 | 0 | 1 |
| 4 | 70-71 | 0 | 1 |
| 5 | 72-73 | 10 | 1 |
| 6 | 74-75 | 10 | 1 |
| 7 | 76-77 | 30 | 1 |
| 8 | 78-79 | 60 | 2 |
| 9 | 80-81 | 90 | 5 |
| 10 | 82-83 | 90 | 5 |
| 11 | 84-85 | 100 | 10 |
| 12 | 86-87 | 120 | 10 |
| ⋮ | ⋮ | ⋮ | ⋮ |
| 62 | 186-187 | 40 | 2 |
| 63 | 188-189 | 20 | 1 |
| 64 | 190-191 | 10 | 1 |

| | | | | |
|---|---|---|---|---|
| SEG11 | SEG21 | SEG31 | SEG14 | SEG15 |
| SEG12 | SEG22 | SEG32 | SEG24 | SEG25 |
| SEG13 | SEG23 | SEG33 | SEG34 | SEG35 |
| SEG14 | SEG24 | SEG34 | SEG44 | SEG45 |
| SEG15 | SEG25 | SEG35 | SEG45 | SEG55 |

FIG. 14

| STAGE | INPUT IMAGE LUMINANCE | FLICKER VALUE | FREQUENCY(Hz) |
|---|---|---|---|
| 1 | LA1 | 0 | 1 |
| 2 | LA2 | 0 | 1 |
| 3 | LA3 | 40 | 2 |
| 4 | LA4 | 80 | 5 |
| 5 | LA5 | 120 | 10 |
| 6 | LA6 | 160 | 30 |
| 7 | LA7 | 200 | 60 |
| ⋮ | ⋮ | ⋮ | ⋮ |
| 60 | LA60 | 0 | 1 |
| 61 | LA61 | 0 | 1 |
| 62 | LA62 | 0 | 1 |
| 63 | LA63 | 0 | 1 |
| 64 | LA64 | 0 | 1 |

DISPLAY APPARATUS AND METHOD OF DRIVING DISPLAY PANEL USING THE SAME

PRIORITY STATEMENT

This application claims priority under 35 U.S.C. § 119 to Korean Patent Application No. 10-2019-0087239, filed on Jul. 18, 2019 in the Korean Intellectual Property Office KIPO, the contents of which are herein incorporated by reference in their entireties.

BACKGROUND

Technical Field

The present disclosure relates to a display apparatus and a method of driving a display panel using the display apparatus. More particularly, the present disclosure relates to a display apparatus reducing power consumption and enhancing a display quality and a method of driving a display panel using the display apparatus.

Description of the Related Art

A method to minimize a power consumption of an electronic device such as a tablet PC and a note PC have been studied.

To minimize the power consumption of the electronic device which includes a display panel, a power consumption of the display panel must be minimized. When the display panel displays a still image, the display panel may be driven in a relatively low frequency so that a power consumption of the display panel can be reduced.

However, when the display panel is driven in the relatively low frequency, a flicker may be generated so that a display quality may decrease. Therefore, a novel and improves way to reduce a power consumption and enhance a display quality is, therefore, needed

SUMMARY

The present disclosure provides a display apparatus capable of reducing a power consumption and enhancing a display quality.

The present disclosure also provides a method of driving a display panel using the display apparatus.

In an example embodiment, the display apparatus includes a display panel, a gate driver, a data driver and a driving controller. The display panel is configure to display an image based on input image data. The gate driver is configured to output a gate signal to a gate line of the display panel. The data driver is configured to output a data voltage to a data line of the display panel. The driving controller is configured to control an operation of the gate driver and an operation of the data driver, to determine a driving mode of the display apparatus between a normal driving mode and a low frequency driving mode, and to determine a driving frequency of the display panel based on the input image data. The driving controller includes a flicker value storage configured to store flicker values for a part of grayscale values among all of grayscale values of the input image data.

In an example embodiment, the driving controller may include a still image determiner configured to determine whether the input image data is a still image or a video image and configured to generate a flag representing whether the input image data is the still image or the video image and a driving frequency determiner configured to determine the driving mode of the display apparatus among one of the normal driving mode and the low frequency driving mode based on the flag and configured to determine the driving frequency of the display panel by the flicker value storage.

In an example embodiment, the flicker value storage may be configured to set a first reference grayscale value, configured to divide grayscale values equal to or less than the first reference grayscale value by a number of flicker setting stages and configured to respectively store flicker values for the grayscale value divided by the number of the flicker setting stages.

In an example embodiment, the driving frequency determiner may be configured to determine the driving frequency for grayscale values greater than the first reference grayscale value based on a flicker value of a last flicker setting stage among all of the flicker setting stages.

In an example embodiment, when a minimum grayscale value of the input image data is 0, a maximum grayscale value of the input image data is 255, the number of flicker setting stages is 64 and the first reference grayscale value is 127, the flicker value storage may be configured to store a single flicker value for two grayscale values.

In an example embodiment, when a minimum grayscale value of the input image data is 0, a maximum grayscale value of the input image data is 255, the number of flicker setting stages is 64 and the first reference grayscale value is 63, the flicker value storage may be configured to store a single flicker value for a single grayscale value.

In an example embodiment, the flicker value storage may be configured to set a second reference grayscale value, configured to divide grayscale values equal to or greater than the second reference grayscale value by a number of flicker setting stages and configured to respectively store flicker values for the grayscale value divided by the number of the flicker setting stages.

In an example embodiment, the driving frequency determiner may be configured to determine the driving frequency for grayscale values less than the second reference grayscale value based on a flicker value of a first flicker setting stage among all of the flicker setting stages.

In an example embodiment, the flicker value storage may be configured to set a first reference grayscale value and a second reference grayscale value, configured to divide grayscale values equal to or less than the first reference grayscale value and equal to or greater than the second reference grayscale value by a number of flicker setting stages and configured to respectively store flicker values for the grayscale value divided by the number of the flicker setting stages.

In an example embodiment, the driving frequency determiner may be configured to determine the driving frequency for grayscale values greater than the first reference grayscale value based on a flicker value of a last flicker setting stage among all of the flicker setting stages. The driving frequency determiner may be configured to determine the driving frequency for grayscale values less than the second reference grayscale value based on a flicker value of a first flicker setting stage among all of the flicker setting stages.

In an example embodiment, the display panel may include a plurality of segments formed in a matrix. The driving controller may be configured to determine the driving frequency of the display panel based on optimal driving frequencies for the segments.

In an example embodiment, the flicker value storage may be configured to store flicker values for a part of luminances among all of luminances of the input image data.

In an example embodiment of a method of driving a display panel, the method includes a step of determining a driving mode of a display apparatus between a normal driving mode and a low frequency driving mode, a step of determining a driving frequency of the display panel by a flicker value storage configured to store flicker values for a part of grayscale values between grayscale values of the input image data, a step of outputting a gate signal to a gate line of the display panel based on the driving frequency, and a step of outputting a data voltage to a data line of the display panel based on the driving frequency.

In an example embodiment, the determining the step of driving frequency may include a step of determining whether the input image data is a still image or a video image, a step of generating a flag representing whether the input image data is the still image or the video image, a step of determining the driving mode of the display apparatus among one of the normal driving mode and the low frequency driving mode based on the flag, and a step of determining the driving frequency of the display panel by the flicker value storage.

In an example embodiment, the flicker value storage may be configured to set a first reference grayscale value, configured to divide grayscale values equal to or less than the first reference grayscale value by a number of flicker setting stages and configured to respectively store flicker values for the grayscale value divided by the number of the flicker setting stages.

In an example embodiment, the step of determining the driving frequency may further include a step of determining the driving frequency for grayscale values greater than the first reference grayscale value based on a flicker value of a last flicker setting stage among all of the flicker setting stages.

In an example embodiment, the flicker value storage may be configured to set a second reference grayscale value, configured to divide grayscale values equal to or greater than the second reference grayscale value by a number of flicker setting stages and configured to respectively store flicker values for the grayscale value divided by the number of the flicker setting stages.

In an example embodiment, the step of determining the driving frequency may further include determining the driving frequency for grayscale values less than the second reference grayscale value based on a flicker value of a first flicker setting stage among all of the flicker setting stages.

In an example embodiment, the flicker value storage may be configured to set a first reference grayscale value and a second reference grayscale value, configured to divide grayscale values equal to or less than the first reference grayscale value and equal to or greater than the second reference grayscale value by a number of flicker setting stages, and configured to respectively store flicker values for the grayscale value divided by the number of the flicker setting stages.

In an example embodiment, the step of determining the driving frequency may further include determining the driving frequency for grayscale values greater than the first reference grayscale value based on a flicker value of a last flicker setting stage among all of the flicker setting stages. The step of determining the driving frequency may further include determining the driving frequency for grayscale values less than the second reference grayscale value based on a flicker value of a first flicker setting stage among all of the flicker setting stages.

According to the method of driving the display panel and the display apparatus for performing the display panel, the driving frequency is determined according to an image displayed on the display panel so that a power consumption of the display apparatus may be reduced. In addition, the driving frequency is determined using the flicker value of the image on the display panel so that a flicker of the image may be prevented and a display quality of the display panel may be enhanced. In addition, the flicker value storage stores the flicker values not for all grayscale values but for a part of grayscale values so that the flicker may be effectively prevented. Thus, the display quality of the display panel may be enhanced.

BRIEF DESCRIPTION OF THE DRAWINGS

The above and other features and advantages of the present disclosure will become more apparent by describing in detailed example embodiments thereof with reference to the accompanying drawings, in which:

FIG. 3 is a table illustrating an example flicker value storage of FIG. 2;

FIG. 4 is a table illustrating an example flicker value storage of FIG. 2;

FIG. 6 is a table illustrating an example flicker value storage of FIG. 2;

FIG. 8 is a table illustrating an example flicker value storage of FIG. 2;

FIG. 9 is a table illustrating an example flicker value storage of FIG. 2;

FIG. 10 is a table illustrating an example flicker value storage of FIG. 2;

FIG. 14 is a table illustrating an example flicker value storage of FIG. 13;

DETAILED DESCRIPTION OF THE EMBODIMENT

Hereinafter, the present disclosure will be explained in detail with reference to the accompanying drawings.

Figure 1:
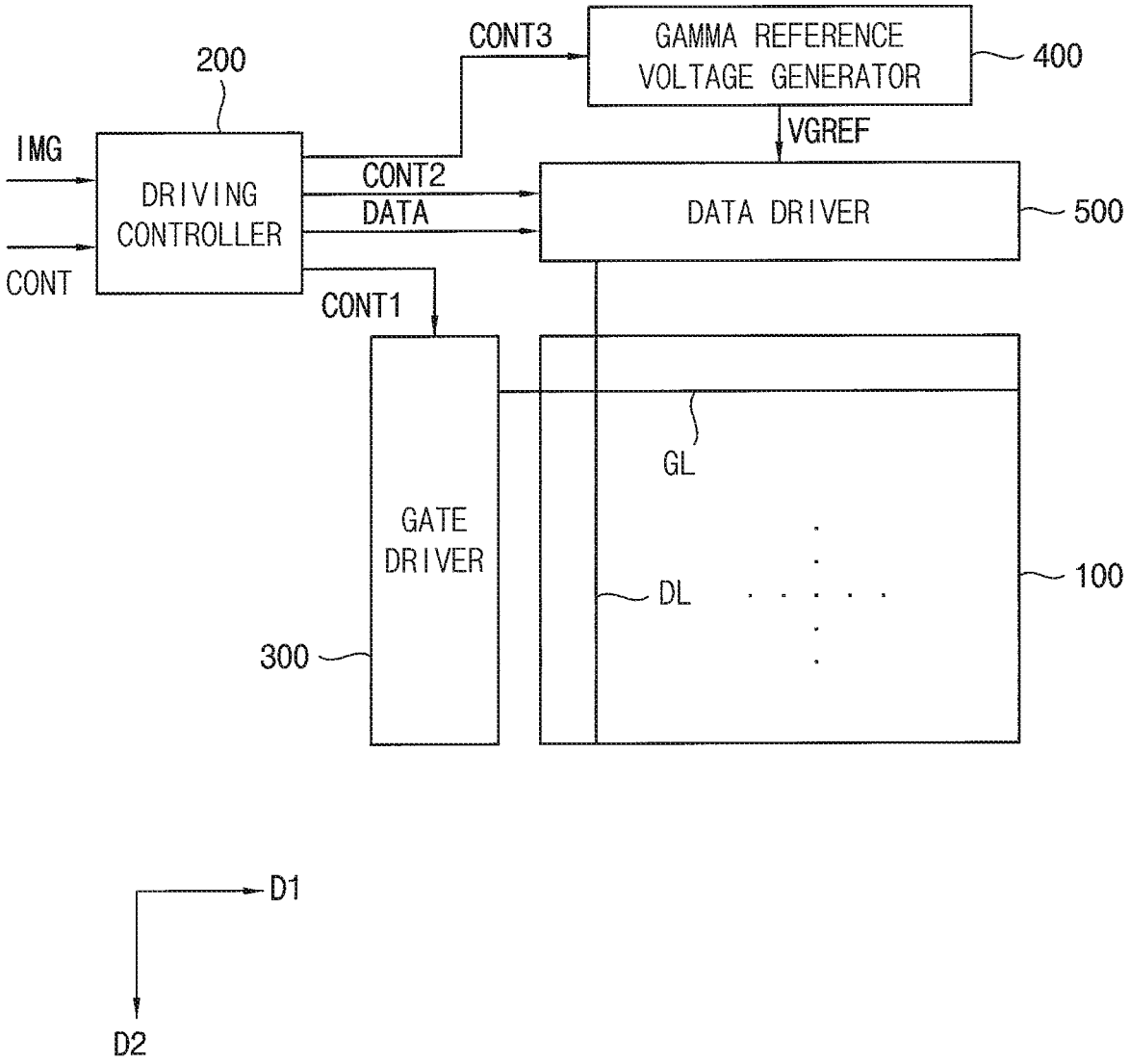
FIG. 1 is a block diagram illustrating a display apparatus according to an example embodiment of the present disclosure.

FIG. 1 is a block diagram illustrating a display apparatus according to an example embodiment of the present disclosure.

Referring to FIG. 1, the display apparatus includes a display panel 100 and a display panel driver. The display panel driver includes a driving controller 200, a gate driver 300, a gamma reference voltage generator 400, and a data driver 500.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called to a timing controller embedded data driver (TED).

The display panel 100 has a display region on which an image is displayed and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus (not shown). The input image data IMG may include a plurality of image data such as red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

For example, the driving controller 200 may adjust a driving frequency of the display panel 100 based on the input image data IMG.

The driving controller 200 generates the third control signal CONT3 for controlling an operation of the gamma reference voltage generator 400 based on the input control signal CONT, and outputs the third control signal CONT3 to the gamma reference voltage generator 400.

A structure and an operation of the driving controller 200 are explained referring to FIGS. 2 to 7 in detail.

Referring back to FIG. 1, the gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be mounted on the display panel 100. For example, the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be positioned in the driving controller 200, or in the data driver 500.

The data driver 500 receives the second control signal CONT2 and the data signal DATA coming from the driving controller 200, and receives the gamma reference voltages VGREF coming from the gamma reference voltage generator 400. The data driver 500 converts the data signal DATA into data voltages having an analog type using the gamma reference voltages VGREF. The data driver 500 outputs the data voltages to the data lines DL.

Figure 2:
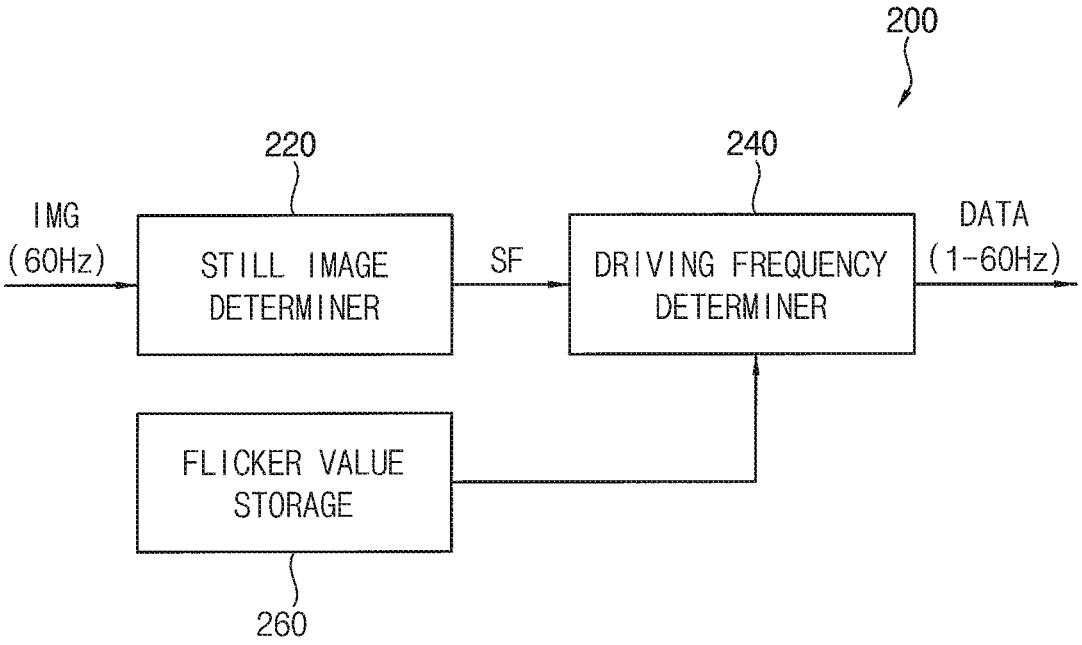
FIG. 2 is a block diagram illustrating a driving controller of FIG. 1.
Figure 5:
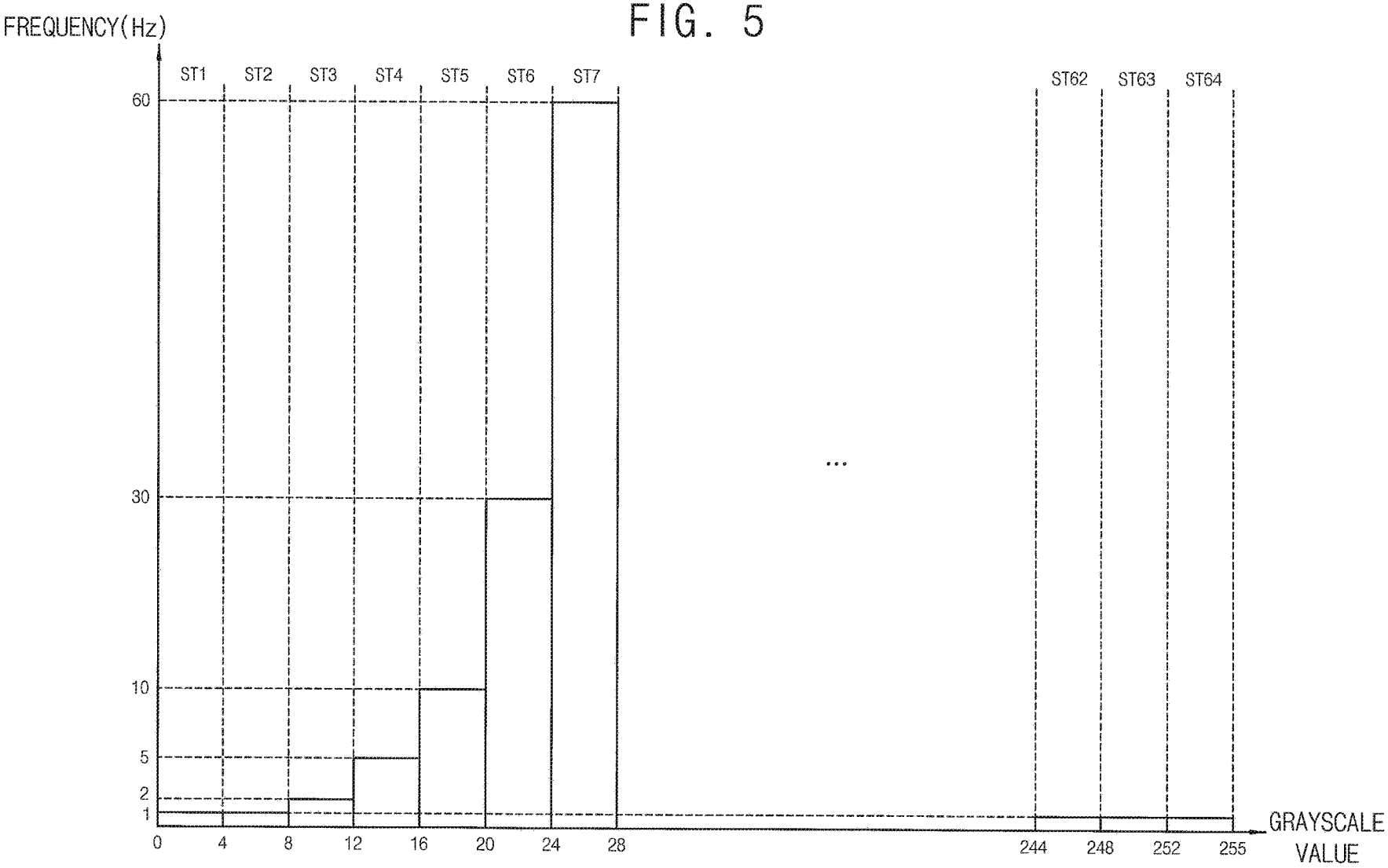
FIG. 5 is a graph illustrating a driving frequency according to input grayscale values corresponding to the table of FIG. 3.

FIG. 2 is a block diagram illustrating the driving controller 200 of FIG. 1. FIG. 3 is a table illustrating an example flicker value storage 260 of FIG. 2. FIG. 4 is a table illustrating an example flicker value storage 260 of FIG. 2. FIG. 5 is a graph illustrating a driving frequency according to input grayscale values corresponding to the table of FIG. 3.

As depicted in FIG. 2, the driving controller 200 may include a still image determiner 220, a driving frequency determiner 240 and a flicker value storage 260.

The still image determiner 220 may determine whether the input image data IMG is a still image or a video image. The still image determiner 220 may output a flag SF representing whether the input image data IMG is the still image or the video image to the driving frequency determiner 240. For example, when the input image data IMG is the still image, the still image determiner 220 may output the flag SF of 1 to the driving frequency determiner 240. When the input image data IMG is the video image, the still image determiner 220 may output the flag SF of 0 to the driving frequency determiner 240. When the display panel 100 is operated in always on mode, the still image determiner 220 may output the flag SF of 1 to the driving frequency determiner 240.

When the flag SF is 1, the driving frequency determiner 240 may drive the display panel 100 in a low driving frequency.

When the flag SF is 0, the driving frequency determiner 240 may drive the display panel 100 in a normal driving frequency.

The driving frequency determiner 240 may refer the flicker value storage 260 to determine the low driving frequency. The flicker value storage 260 may include a flicker value representing a degree of a flicker according to a grayscale value of the input image data IMG.

The flicker value storage 260 may store the grayscale value of the input image data IMG and the flicker value corresponding to the grayscale value of the input image data IMG. The flicker value may be used for determining the driving frequency of the display panel 100.

In FIG. 3, the input grayscale value of the input image data IMG may be 8 bits, the minimum grayscale value of the input image data IMG may be 0 and the maximum grayscale value of the input image data IMG may be 255. The number of flicker setting stages of the flicker value storage 260 may be 64. When the number of the flicker setting stages increases, the flicker may be effectively removed but a logic size of the driving controller 200 may increase. Thus, the number of the flicker setting stages may be limited.

In FIG. 3, the number of the grayscale values of the input image data IMG is 256 and the number of the flicker setting stages is 64 so that a single flicker value in the flicker value storage 260 may correspond to four grayscale values. For example, a first flicker setting stage stores the flicker value of 0 for the grayscale values of 0 to 3. Herein, the flicker value of 0 may represent the driving frequency of 1 Hz. For example, a second flicker setting stage stores the flicker value of 0 for the grayscale values of 4 to 7. Herein, the flicker value of 0 may represent the driving frequency of 1 Hz. For example, a third flicker setting stage stores the flicker value of 40 for the grayscale values of 8 to 11. Herein, the flicker value of 40 may represent the driving frequency of 2 Hz. For example, a fourth flicker setting stage stores the flicker value of 80 for the grayscale values of 12 to 15. Herein, the flicker value of 80 may represent the driving frequency of 5 Hz. For example, a fifth flicker setting stage stores the flicker value of 120 for the grayscale values of 16 to 19. Herein, the flicker value of 120 may represent the driving frequency of 10 Hz. For example, a sixth flicker setting stage stores the flicker value of 160 for the grayscale values of 20 to 23. Herein, the flicker value of 160 may represent the driving frequency of 30 Hz. For example, a seventh flicker setting stage stores the flicker value of 200 for the grayscale values of 24 to 27. Herein, the flicker value of 200 may represent the driving frequency of 60 Hz. For example, a sixty second flicker setting stage stores the flicker value of 0 for the grayscale values of 244 to 247. Herein, the flicker value of 0 may represent the driving frequency of 1 Hz. For example, a sixty third flicker setting stage stores the flicker value of 0 for the grayscale values of 248 to 251. Herein, the flicker value of 0 may represent the driving frequency of 1 Hz. For example, a sixty fourth flicker setting stage stores the flicker value of 0 for the grayscale values of 252 to 255. Herein, the flicker value of 0 may represent the driving frequency of 1 Hz.

In FIG. 4, the input grayscale value of the input image data IMG may be 10 bits, the minimum grayscale value of the input image data IMG may be 0, and the maximum grayscale value of the input image data IMG may be 1023. The number of flicker setting stages of the flicker value storage 260 may be 64.

In FIG. 4, the number of the grayscale values of the input image data IMG is 1024 and the number of the flicker setting stages is 64 so that a single flicker value in the flicker value storage 260 may correspond to sixteen grayscale values.

The graph of FIG. 5 represents the driving frequency according to the input grayscale value of the flicker value storage 260 of FIG. 3. For example, the driving frequency corresponding to the grayscale value of 0 to 3 of the first flicker setting stage ST1 may be 1 Hz. For example, the driving frequency corresponding to the grayscale value of 4 to 7 of the second flicker setting stage ST2 may be 1 Hz. For example, the driving frequency corresponding to the grayscale value of 8 to 11 of the third flicker setting stage ST3 may be 2 Hz. For example, the driving frequency corresponding to the grayscale value of 12 to 15 of the fourth flicker setting stage ST4 may be 5 Hz. For example, the driving frequency corresponding to the grayscale value of 16 to 19 of the fifth flicker setting stage ST5 may be 10 Hz. For example, the driving frequency corresponding to the grayscale value of 20 to 23 of the sixth flicker setting stage ST6 may be 30 Hz. For example, the driving frequency corresponding to the grayscale value of 24 to 27 of the seventh flicker setting stage ST7 may be 60 Hz.

In FIGS. 3 and 5, due to a limit of the size of the flicker value storage 260, the flicker value storage 260 may store only one flicker value for four grayscale values. In addition, in FIG. 4, due to a limit of the size of the flicker value storage 260, the flicker value storage 260 may store only one flicker value for sixteen grayscale values.

Assume that the flicker is not shown to a user when the grayscale value is 8 or 9 and the driving frequency is 1 Hz and the flicker is shown to the user when the grayscale value is 10 or 11 and the driving frequency is 1 Hz. In this case, the display panel 100 may be driven in the driving frequency of 2 Hz for the grayscale values of 8 to 11 according to FIG. 3.

If the flicker values may be respectively set for the grayscale values of 8 and 9 and for the grayscale values of 10 and 11, the display panel 100 may be driven in the driving frequency of 1 Hz for the grayscale values of 8 and 9 and the display panel 100 may be driven in the driving frequency of 2 Hz for the gray scale values of 10 and 11 so that the power consumption may be further reduced.

Figure 7:
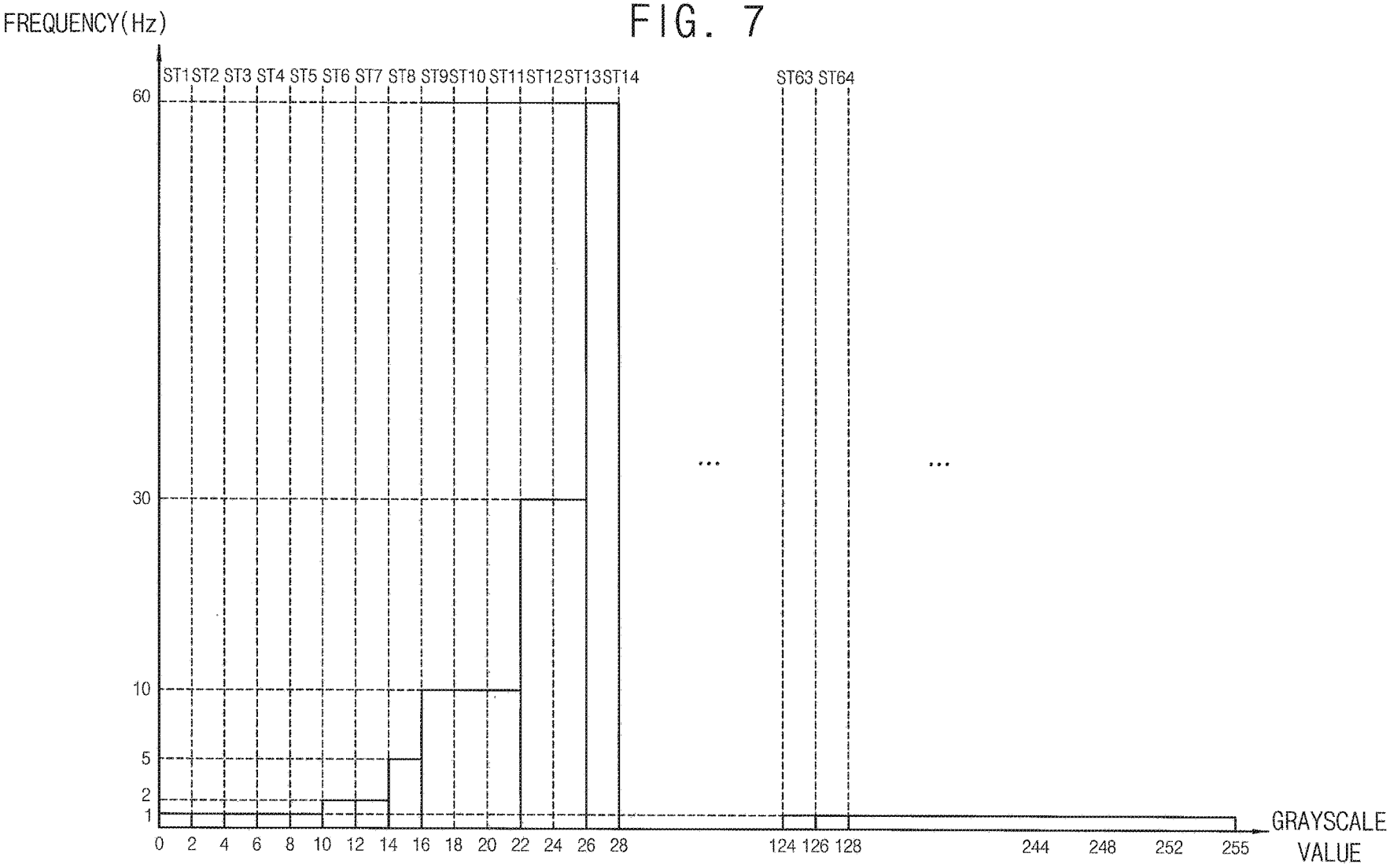
FIG. 7 is a graph illustrating a driving frequency according to input grayscale values corresponding to the table of FIG. 6.

FIG. 6 is a table illustrating an example flicker value storage 260 of FIG. 2. FIG. 7 is a graph illustrating a driving frequency according to input grayscale values corresponding to the table of FIG. 6.

Referring to FIGS. 1 to 7, the flicker value storage 260 may store the flicker values for a part of the grayscale values (e.g. 0 to 127) among all of the grayscale values (e.g. 0 to 256) of the input image data IMG.

In FIG. 6, the input grayscale value of the input image data IMG may be 8 bits. The flicker value storage 260 of FIG. 6 may set a first reference grayscale value (e.g. 127) and may divide the grayscale values (e.g. 0 to 127) equal to or less than the first reference grayscale value by the number of the flicker setting stages (e.g. 64) and may respectively store the flicker values for the grayscale values (e.g. 0 to 127) divided by the number of the flicker setting stages (e.g. 64).

For example, the minimum grayscale value of the input image data IMG may be 0, the maximum grayscale value of the input image data IMG may be 255, the number of flicker setting stages of the flicker value storage 260 may be 64 and the first reference grayscale value may be set to 127. Thus, the flicker value storage 260 of FIG. 6 stores the flicker values only for the grayscale values (e.g. 0 to 127) equal to or less than the first reference grayscale value. When the minimum grayscale value of the input image data IMG is 0, the maximum grayscale value of the input image data IMG is 255, the number of flicker setting stages is 64 and the first reference grayscale value is 127, the flicker value storage 260 may store a single flicker value for two grayscale values. For example, a first flicker setting stage stores the flicker value of 0 for the grayscale values of 0 and 1. Herein, the flicker value of 0 may represent the driving frequency of 1 Hz. For example, a second flicker setting stage stores the flicker value of 0 for the grayscale values of 2 and 3. Herein, the flicker value of 0 may represent the driving frequency of 1 Hz. For example, a third flicker setting stage stores the flicker value of 0 for the grayscale values of 4 and 5. Herein, the flicker value of 0 may represent the driving frequency of 1 Hz. For example, a fourth flicker setting stage stores the flicker value of 0 for the grayscale values of 6 and 7. Herein, the flicker value of 0 may represent the driving frequency of 1 Hz. For example, a fifth flicker setting stage stores the flicker value of 10 for the grayscale values of 8 and 9. Herein, the flicker value of 10 may represent the driving frequency of 1 Hz. For example, a sixth flicker setting stage stores the flicker value of 50 for the grayscale values of 10 and 11. Herein, the flicker value of 50 may represent the driving frequency of 2 Hz. For example, a seventh flicker setting stage stores the flicker value of 60 for the grayscale values of 12 and 13. Herein, the flicker value of 60 may represent the driving frequency of 2 Hz. For example, an eighth flicker setting stage stores the flicker value of 90 for the grayscale values of 14 and 15. Herein, the flicker value of 90 may represent the driving frequency of 5 Hz. For example, a ninth flicker setting stage stores the flicker value of 110 for the grayscale values of 16 and 17. Herein, the flicker value of 110 may represent the driving frequency of 10 Hz. For example, a tenth flicker setting stage stores the flicker value of 120 for the grayscale values of 18 and 19. Herein, the flicker value of 120 may represent the driving frequency of 10 Hz.

The driving frequency determiner 240 may determine the driving frequency (e.g. 1 Hz) for the grayscale values (e.g. 128 to 255) greater than the first reference grayscale value (e.g. 127) based on the flicker value (e.g. 0) of the last flicker setting stage (e.g. the sixty fourth flicker setting stage) among all of the flicker setting stages.

When the flicker is generated not in a high grayscale region but in a low grayscale region according to the characteristics of the display panel 100, the flicker value storage 260 may selectively store the flicker values not for all of the for the grayscale values but for the grayscale values in the low grayscale region so that the flicker values for a target grayscale region (the low grayscale region) may be subdivided and stored in a constraint of the size of the flicker value storage 260.

The graph of FIG. 7 represents the driving frequency according to the input grayscale value of the flicker value storage 260 of FIG. 6. For example, the driving frequency corresponding to the grayscale value of 0 and 1 of the first flicker setting stage ST1 may be 1 Hz. For example, the driving frequency corresponding to the grayscale value of 2 and 3 of the second flicker setting stage ST2 may be 1 Hz. For example, the driving frequency corresponding to the grayscale value of 4 and 5 of the third flicker setting stage ST3 may be 1 Hz. For example, the driving frequency corresponding to the grayscale value of 6 and 7 of the fourth flicker setting stage ST4 may be 1 Hz. For example, the driving frequency corresponding to the grayscale value of 8 and 9 of the fifth flicker setting stage ST5 may be 1 Hz. For example, the driving frequency corresponding to the grayscale value of 10 and 11 of the sixth flicker setting stage ST6 may be 2 Hz. For example, the driving frequency corresponding to the grayscale value of 12 and 13 of the seventh flicker setting stage ST7 may be 2 Hz. For example, the driving frequency corresponding to the grayscale value of 14 and 15 of the eighth flicker setting stage ST8 may be 5 Hz. For example, the driving frequency corresponding to the grayscale value of 16 and 17 of the ninth flicker setting stage ST9 may be 10 Hz. For example, the driving frequency corresponding to the grayscale value of 18 and 19 of the ninth flicker setting stage ST10 may be 10 Hz.

Assume that the flicker is not shown to a user when the grayscale value is 8 or 9 and the driving frequency is 1 Hz and the flicker is shown to the user when the grayscale value is 10 or 11 and the driving frequency is 1 Hz. In this case, the display panel 100 may be driven in the driving frequency of 1 Hz for the grayscale values of 8 and 9 and the display panel 100 may be driven in the driving frequency of 2 Hz for the grayscale values of 10 and 11 according to FIG. 6. Thus, the flicker value storage 260 in FIG. 6 may further reduce the power consumption and effectively prevent the flicker than the flicker value storage 260 in FIG. 3.

FIG. 8 is a table illustrating an example flicker value storage 260 of FIG. 2.

Referring to FIGS. 1, 2 and 8, the flicker value storage 260 may store the flicker values for a part of the grayscale values (e.g. 0 to 63) among all of the grayscale values (e.g. 0 to 256) of the input image data IMG.

In FIG. 8, the input grayscale value of the input image data IMG may be 8 bits. The flicker value storage 260 of FIG. 8 may set a first reference grayscale value (e.g. 63) and may divide the grayscale values (e.g. 0 to 63) equal to or less than the first reference grayscale value by the number of the flicker setting stages (e.g. 64) and may respectively store the flicker values for the grayscale values (e.g. 0 to 63) divided by the number of the flicker setting stages (e.g. 64).

For example, the minimum grayscale value of the input image data IMG may be 0, the maximum grayscale value of the input image data IMG may be 255, the number of flicker setting stages of the flicker value storage 260 may be 64 and the first reference grayscale value may be set to 63. Thus, the flicker value storage 260 of FIG. 8 stores the flicker values only for the grayscale values (e.g. 0 to 63) equal to or less than the first reference grayscale value. When the minimum grayscale value of the input image data IMG is 0, the maximum grayscale value of the input image data IMG is 255, the number of flicker setting stages is 64 and the first reference grayscale value is 63, the flicker value storage 260 may store a single flicker value for a single grayscale value. For example, a first flicker setting stage stores the flicker value of 0 for the grayscale value of 0. Herein, the flicker value of 0 may represent the driving frequency of 1 Hz. For example, a second flicker setting stage stores the flicker value of 0 for the grayscale value of 1. Herein, the flicker value of 0 may represent the driving frequency of 1 Hz. For example, a third flicker setting stage stores the flicker value of 0 for the grayscale value of 2. Herein, the flicker value of 0 may represent the driving frequency of 1 Hz. For example, a fourth flicker setting stage stores the flicker value of 0 for the grayscale value of 3. Herein, the flicker value of 0 may represent the driving frequency of 1 Hz. For example, a ninth flicker setting stage stores the flicker value of 10 for the grayscale value of 8. Herein, the flicker value of 10 may represent the driving frequency of 1 Hz. For example, a tenth flicker setting stage stores the flicker value of 20 for the grayscale value of 9. Herein, the flicker value of 20 may represent the driving frequency of 1 Hz. For example, an eleventh flicker setting stage stores the flicker value of 40 for the grayscale value of 10. Herein, the flicker value of 40 may represent the driving frequency of 2 Hz. For example, a twelfth flicker setting stage stores the flicker value of 55 for the grayscale value of 11. Herein, the flicker value of 55 may represent the driving frequency of 2 Hz.

The driving frequency determiner 240 may determine the driving frequency (e.g. 1 Hz) for the grayscale values (e.g. 64 to 255) greater than the first reference grayscale value (e.g. 63) based on the flicker value (e.g. 0) of the last flicker setting stage (e.g. the sixty fourth flicker setting stage) among all of the flicker setting stages.

When the flicker is generated not in a high grayscale region but in a low grayscale region according to the characteristics of the display panel 100, the flicker value storage 260 may selectively store the flicker values not for all of the for the grayscale values but for the grayscale values in the low grayscale region so that the flicker values for the target grayscale region (the low grayscale region) may be subdivided and stored in a constraint of the size of the flicker value storage 260.

FIG. 9 is a table illustrating an example flicker value storage 260 of FIG. 2.

Referring to FIGS. 1, 2 and 9, the flicker value storage 260 may store the flicker values for a part of the grayscale values (e.g. 128 to 255) among all of the grayscale values (e.g. 0 to 256) of the input image data IMG.

In FIG. 9, the input grayscale value of the input image data IMG may be 8 bits. The flicker value storage 260 of FIG. 9 may set a second reference grayscale value (e.g. 128) and may divide the grayscale values (e.g. 128 to 255) equal to or greater than the second reference grayscale value by the number of the flicker setting stages (e.g. 64) and may respectively store the flicker values for the grayscale values (e.g. 128 to 255) divided by the number of the flicker setting stages (e.g. 64).

For example, the minimum grayscale value of the input image data IMG may be 0, the maximum grayscale value of the input image data IMG may be 255, the number of flicker setting stages of the flicker value storage 260 may be 64 and the second reference grayscale value may be set to 128. Thus, the flicker value storage 260 of FIG. 9 stores the flicker values only for the grayscale values (e.g. 128 to 255) equal to or greater than the second reference grayscale value. When the minimum grayscale value of the input image data IMG is 0, the maximum grayscale value of the input image data IMG is 255, the number of flicker setting stages is 64 and the second reference gray scale value is 128, the flicker value storage 260 may store a single flicker value for two grayscale values. For example, a first flicker setting stage stores the flicker value of 0 for the grayscale values of 128 and 129. Herein, the flicker value of 0 may represent the driving frequency of 1 Hz. For example, a second flicker setting stage stores the flicker value of 0 for the grayscale values of 130 and 131. Herein, the flicker value of 0 may represent the driving frequency of 1 Hz. For example, a third flicker setting stage stores the flicker value of 20 for the grayscale values of 132 and 133. Herein, the flicker value of 20 may represent the driving frequency of 1 Hz. For example, a fourth flicker setting stage stores the flicker value of 30 for the grayscale values of 134 and 135. Herein, the flicker value of 30 may represent the driving frequency of 1 Hz. For example, a fifth flicker setting stage stores the flicker value of 40 for the grayscale values of 136 and 137. Herein, the flicker value of 40 may represent the driving frequency of 2 Hz. For example, a sixth flicker setting stage stores the flicker value of 60 for the grayscale values of 138 and 139. Herein, the flicker value of 60 may represent the driving frequency of 2 Hz. For example, a seventh flicker setting stage stores the flicker value of 110 for the grayscale values of 140 and 141. Herein, the flicker value of 110 may represent the driving frequency of 10 Hz. For example, an eighth flicker setting stage stores the flicker value of 130 for the grayscale values of 142 and 143. Herein, the flicker value of 130 may represent the driving frequency of 10 Hz. For example, a ninth flicker setting stage stores the flicker value of 160 for the grayscale values of 144 and 145. Herein, the flicker value of 160 may represent the driving frequency of 30 Hz. For example, a tenth flicker setting stage stores the flicker value of 200 for the grayscale values of 146 and 147. Herein, the flicker value of 200 may represent the driving frequency of 60 Hz.

The driving frequency determiner 240 may determine the driving frequency (e.g. 1 Hz) for the grayscale values (e.g. 0 to 127) less than the second reference grayscale value (e.g. 128) based on the flicker value (e.g. 0) of the first flicker setting stage among all of the flicker setting stages.

When the flicker is generated not in a low grayscale region but in a high grayscale region according to the characteristics of the display panel 100, the flicker value storage 260 may selectively store the flicker values not for all of the for the grayscale values but for the grayscale values in the high grayscale region so that the flicker values for a target grayscale region (the high grayscale region) may be subdivided and stored in a constraint of the size of the flicker value storage 260.

FIG. 10 is a table illustrating an example flicker value storage 260 of FIG. 2.

Referring to FIGS. 1, 2 and 10, the flicker value storage 260 may store the flicker values for a part of the grayscale values (e.g. 64 to 191) among all of the grayscale values (e.g. 0 to 256) of the input image data IMG.

In FIG. 10, the input grayscale value of the input image data IMG may be 8 bits. The flicker value storage 260 of FIG. 10 may set a first reference grayscale value (e.g. 191) and a second reference grayscale value (e.g. 64) and may divide the grayscale values (e.g. 64 to 191) equal to or less than the first reference grayscale value and equal to or greater than the second reference grayscale value by the number of the flicker setting stages (e.g. 64) and may respectively store the flicker values for the grayscale values (e.g. 64 to 191) divided by the number of the flicker setting stages (e.g. 64).

For example, the minimum grayscale value of the input image data IMG may be 0, the maximum grayscale value of the input image data IMG may be 255, the number of flicker setting stages of the flicker value storage 260 may be 64, the first reference grayscale value may be set to 191 and the second reference grayscale value may be set to 64. Thus, the flicker value storage 260 of FIG. 10 stores the flicker values only for the grayscale values (e.g. 64 to 191) equal to or less than the first reference grayscale value and equal to or greater than the second reference grayscale value. When the minimum grayscale value of the input image data IMG is 0, the maximum grayscale value of the input image data IMG is 255, the number of flicker setting stages is 64, the first reference grayscale value is 191 and the second reference grayscale value is 64, the flicker value storage 260 may store a single flicker value for two grayscale values. For example, a first flicker setting stage stores the flicker value of 0 for the grayscale values of 64 and 65. Herein, the flicker value of 0 may represent the driving frequency of 1 Hz. For example, a second flicker setting stage stores the flicker value of 0 for the grayscale values of 66 and 67. Herein, the flicker value of 0 may represent the driving frequency of 1 Hz. For example, a fifth flicker setting stage stores the flicker value of 10 for the grayscale values of 72 and 73. Herein, the flicker value of 10 may represent the driving frequency of 1 Hz. For example, a sixth flicker setting stage stores the flicker value of 10 for the grayscale values of 74 and 75. Herein, the flicker value of 10 may represent the driving frequency of 1 Hz. For example, a ninth flicker setting stage stores the flicker value of 90 for the grayscale values of 80 and 81. Herein, the flicker value of 90 may represent the driving frequency of 5 Hz. For example, a tenth flicker setting stage stores the flicker value of 90 for the grayscale values of 82 and 83. Herein, the flicker value of 90 may represent the driving frequency of 5 Hz.

The driving frequency determiner 240 may determine the driving frequency (e.g. 1 Hz) for the grayscale values (e.g. 192 to 255) greater than the first reference grayscale value (e.g. 191) based on the flicker value (e.g. 10) of the last flicker setting stage (e.g. the sixty fourth flicker setting stage) among all of the flicker setting stages.

The driving frequency determiner 240 may determine the driving frequency (e.g. 1 Hz) for the grayscale values (e.g. 0 to 63) less than the second reference grayscale value (e.g. 64) based on the flicker value (e.g. 0) of the first flicker setting stage among all of the flicker setting stages.

When the flicker is generated not in a low grayscale region and a high grayscale region but in a middle grayscale region according to the characteristics of the display panel 100, the flicker value storage 260 may selectively store the flicker values not for all of the for the grayscale values but for the grayscale values in the middle grayscale region so that the flicker values for a target grayscale region (the middle grayscale region) may be subdivided and stored in a constraint of the size of the flicker value storage 260.

According to the example embodiment, the driving frequency is determined according to the image displayed on the display panel 100 so that the power consumption of the display apparatus may be reduced. In addition, the driving frequency is determined using the flicker value of the image on the display panel 100 so that the flicker of the image may be prevented and the display quality of the display panel 100 may be enhanced. In addition, the flicker value storage 260 stores the flicker values not for all grayscale values but for a part of grayscale values so that the flicker may be effectively prevented. Thus, the display quality of the display panel 100 may be enhanced.

Figures 11, 12:
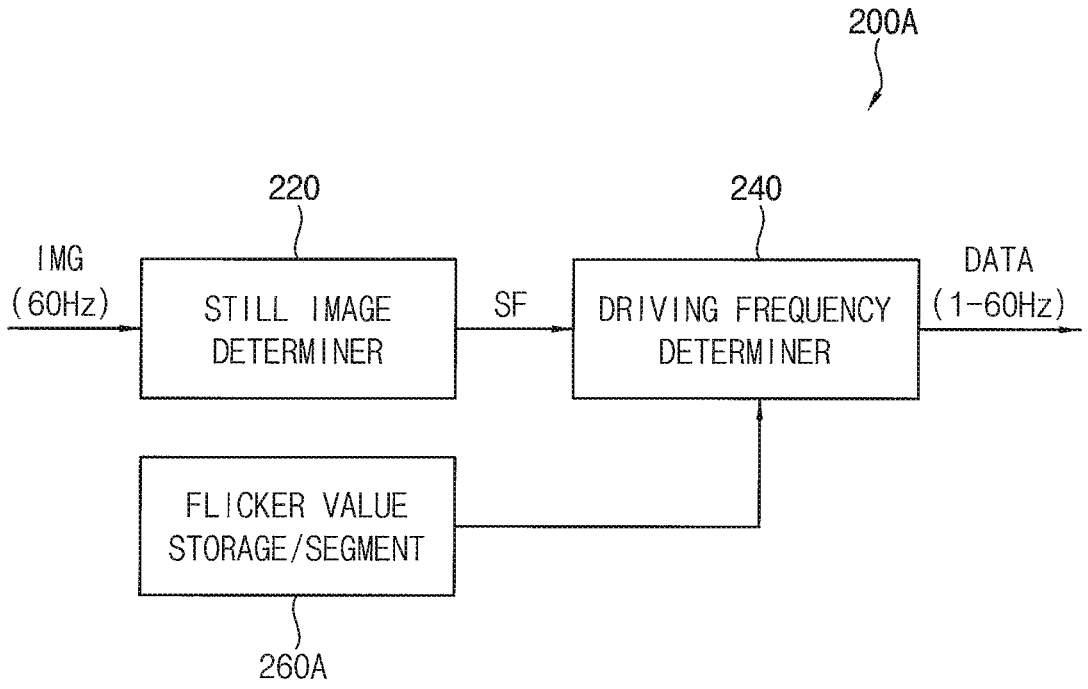
FIG. 11 is a conceptual diagram illustrating a display panel of a display apparatus according to an example embodiment of the present disclosure.
FIG. 12 is a block diagram illustrating a driving controller of the display apparatus of FIG. 11.

FIG. 11 is a conceptual diagram illustrating a display panel of a display apparatus according to an example embodiment. FIG. 12 is a block diagram illustrating a driving controller of the display apparatus of FIG. 11.

The display apparatus and the method of driving the display panel according to the present example embodiment is substantially the same as the display apparatus and the method of driving the display panel of the previous example embodiment explained referring to FIGS. 1 to 10 except that the display panel is divided into a plurality of segments. Thus, the same reference numerals will be used to refer to the same or like parts as those described in the previous example embodiment of FIGS. 1 to 10 and any repetitive explanation concerning the above elements will be omitted.

Referring to FIGS. 1 and 3 to 12, the display apparatus includes a display panel 100 and a display panel driver. The display panel driver includes a driving controller 200A, a gate driver 300, a gamma reference voltage generator 400 and a data driver 500.

As depicted in FIG. 11, the display panel 100 may include a plurality of segments from SEG11 to SEG55. Although the display panel 100 includes the segments in a five by five matrix form in the present example embodiment, the present disclosure is not limited. For example, the display panel 100 may include the segments in a less than 5 by 5 matrix form or a greater than 5 by 5 matrix form.

When the flicker value is determined for a unit of the pixel and only one pixel has a high flicker value, the entire display panel may be driven in a high driving frequency to prevent the flicker in the one pixel. For example, when a flicker of only one pixel is prevented in the driving frequency of 30 Hz and the other pixels do not generate the flicker in the driving frequency of 1 Hz, the display panel 100 may be driven in the driving frequency of 30 Hz and the power consumption of the display apparatus may be higher than necessary.

Thus, when the display panel 100 is divided into the segments and the flicker value is determined for a unit of the segment, the power consumption of the display apparatus may be effectively reduced.

The driving controller 200A may determine optimal driving frequencies for the segments and may determine the maximum driving frequency among the optimal driving frequencies for the segments as the low driving frequency for the display panel 100.

For example, when an optimal driving frequency for a first segment SEG11 is 10 Hz and optimal driving frequencies for the other segments SEG12 to SEG55 except for the first segment SEG11 are 2 Hz, the driving controller 200A may determine the low driving frequency to 10 Hz.

As depicted in FIG. 12, the driving controller 200A may include a still image determiner 220, a driving frequency determiner 240, and a flicker value storage 260A.

The driving frequency determiner 240 may refer the flicker value storage 260A and information of the segment of the display panel 100 to determine the low driving frequency.

According to the present example embodiment, the driving frequency is determined according to the image displayed on the display panel 100 so that the power consumption of the display apparatus may be reduced. In addition, the driving frequency is determined using the flicker values of the segments of the image on the display panel 100 so that the flicker of the image may be prevented and the display quality of the display panel 100 may be enhanced. In addition, the flicker value storage 260A stores the flicker values not for all grayscale values but for a part of grayscale values so that the flicker may be effectively prevented. Thus, the display quality of the display panel 100 may be enhanced.

Figure 13:
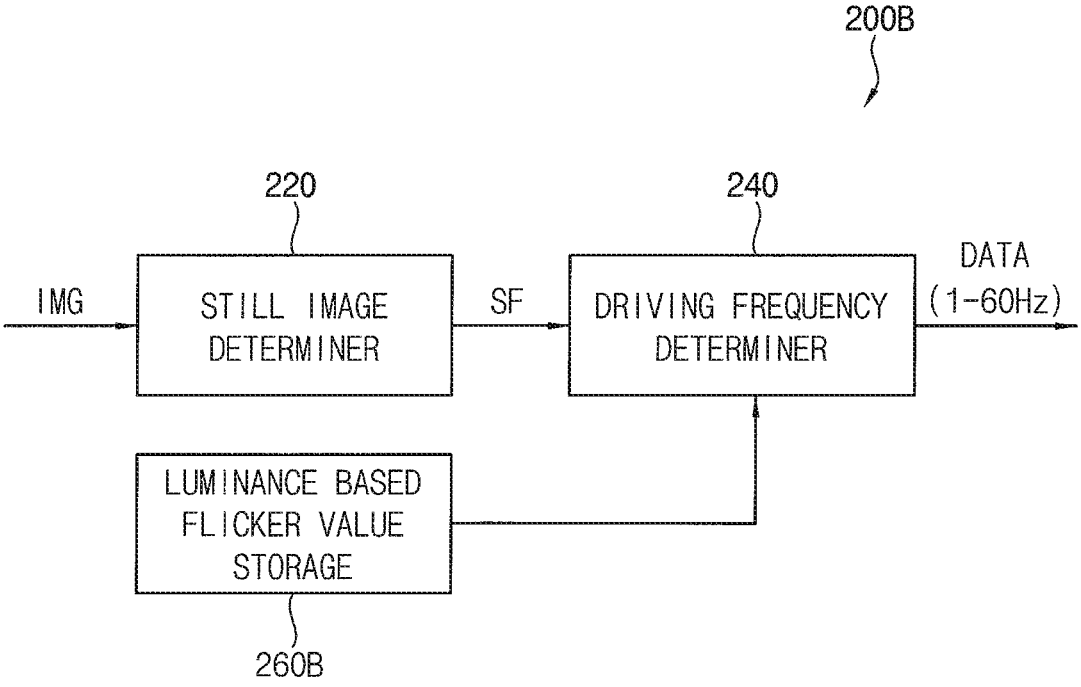
FIG. 13 is a block diagram illustrating a driving controller of a display apparatus according to an example embodiment of the present disclosure.

FIG. 13 is a block diagram illustrating a driving controller 200B of a display apparatus according to an example embodiment of the present disclosure. FIG. 14 is a table illustrating an example flicker value storage 260B of FIG. 13.

The display apparatus and the method of driving the display panel according to the present example embodiment is substantially the same as the display apparatus and the method of driving the display panel of the previous example embodiment explained referring to FIGS. 1 to 10 except for the flicker value storage. Thus, the same reference numerals will be used to refer to the same or like parts as those described in the previous example embodiment of FIGS. 1 to 10 and any repetitive explanation concerning the above elements will be omitted.

Referring to FIGS. 1, 2, 13 and 14, the display apparatus includes a display panel 100 and a display panel driver. The display panel driver includes a driving controller 200B, a gate driver 300, a gamma reference voltage generator 400 and a data driver 500.

As depicted in FIG. 13, the driving controller 200B may include a still image determiner 220, a driving frequency determiner 240 and a flicker value storage 260B.

The still image determiner 220 may determine whether the input image data IMG is a still image or a video image. The still image determiner 220 may output a flag SF representing whether the input image data IMG is the still image or the video image to the driving frequency determiner 240.

When the flag SF is 1, the driving frequency determiner 240 may drive the display panel 100 in a low driving frequency.

When the flag SF is 0, the driving frequency determiner 240 may drive the display panel 100 in a normal driving frequency.

The driving frequency determiner 240 may refer the flicker value storage 260B to determine the low driving frequency. The flicker value storage 260B may include a flicker value representing a degree of a flicker according to a luminance of the input image data IMG.

The flicker value storage 260B may store the luminance of the input image data IMG and the flicker value corresponding to the luminance of the input image data IMG. The flicker value may be used for determining the driving frequency of the display panel 100.

In FIG. 14, luminance of the input image data IMG may be divided into first to sixty fourth luminance area from LA1 to LA64. In addition, the number of the flicker setting stages is 64. For example, a first flicker setting stage stores the flicker value of 0 for a first luminance area LA1. Herein, the flicker value of 0 may represent the driving frequency of 1 Hz. For example, a second flicker setting stage stores the flicker value of 0 for a second luminance area LA2. Herein, the flicker value of 0 may represent the driving frequency of 1 Hz. For example, a third flicker setting stage stores the flicker value of 40 for a third luminance area LA3. Herein, the flicker value of 40 may represent the driving frequency of 2 Hz. For example, a fourth flicker setting stage stores the flicker value of 80 for a fourth luminance area LA4. Herein, the flicker value of 80 may represent the driving frequency of 5 Hz. For example, a sixty third flicker setting stage stores the flicker value of 0 for a sixty third luminance area LA63. Herein, the flicker value of 0 may represent the driving frequency of 1 Hz. For example, a sixty fourth flicker setting stage stores the flicker value of 0 for a sixty third luminance area LA64. Herein, the flicker value of 0 may represent the driving frequency of 1 Hz.

In the present example embodiment, the driving frequency determiner 240 may convert the grayscale value of the input image data IMG to the luminance corresponding to the grayscale value. The driving frequency determiner 240 may extract the flicker value corresponding to the luminance from the flicker value storage 260B to determine the driving frequency.

According to the present example embodiment, the driving frequency is determined according to the image displayed on the display panel 100 so that the power consumption of the display apparatus may be reduced. In addition, the driving frequency is determined using the flicker value of the image on the display panel 100 so that the flicker of the image may be prevented and the display quality of the display panel 100 may be enhanced. In addition, the flicker value storage 260B stores the flicker values not for all luminances but for a part of luminances so that the flicker may be effectively prevented. Thus, the display quality of the display panel 100 may be enhanced.

Figure 15:
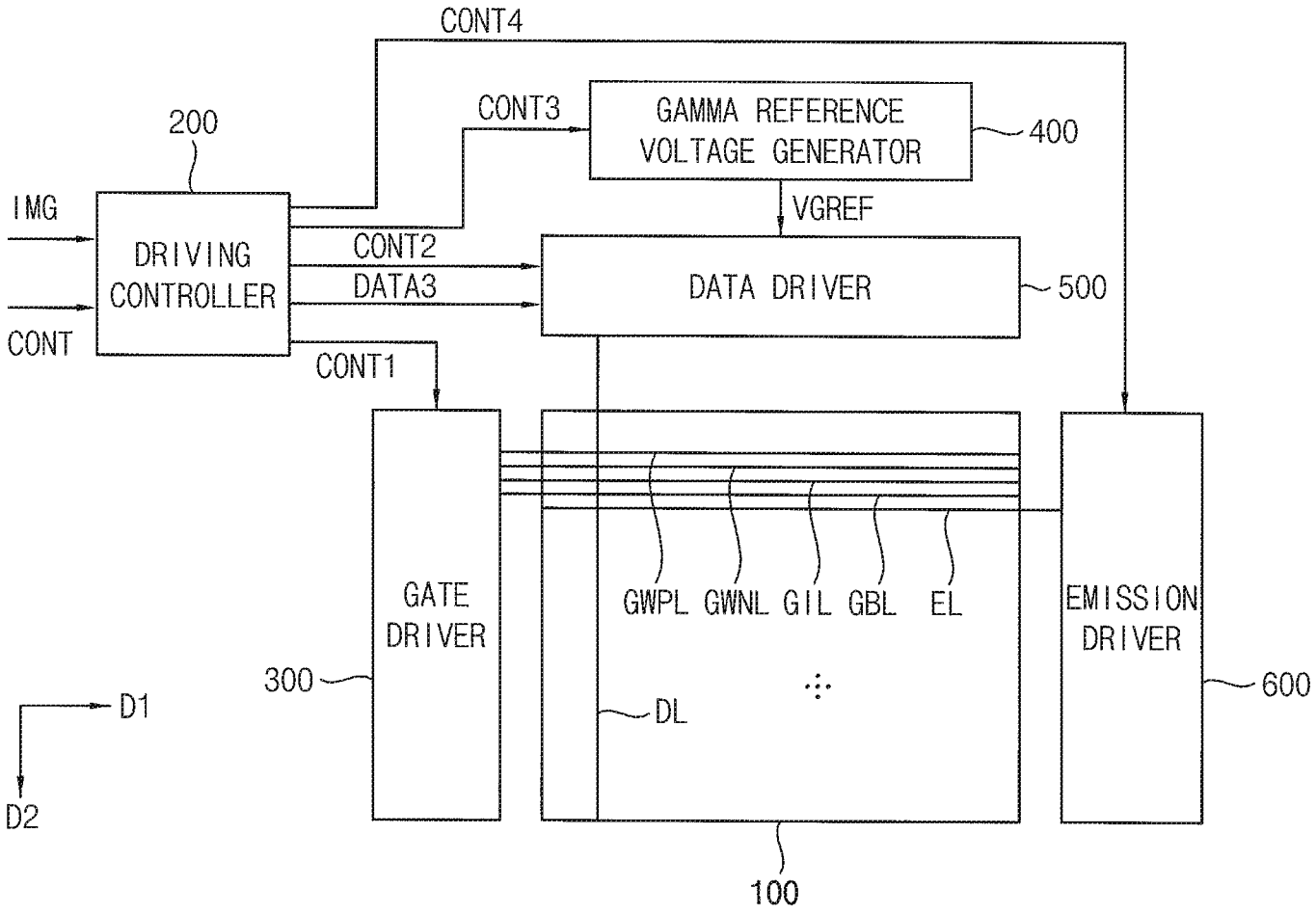
FIG. 15 is a block diagram illustrating a display apparatus according to an example embodiment of the present disclosure.
Figure 16:
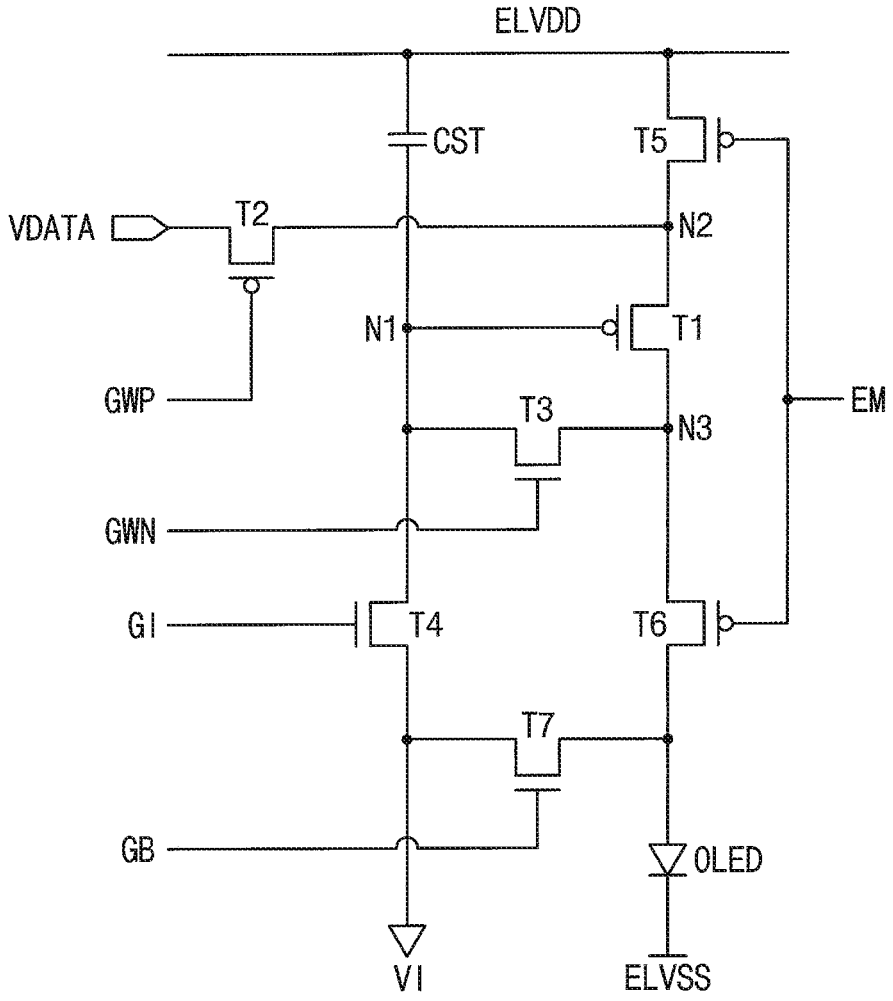
FIG. 16 is a circuit diagram illustrating a pixel of a display panel of FIG. 15.
Figure 17:
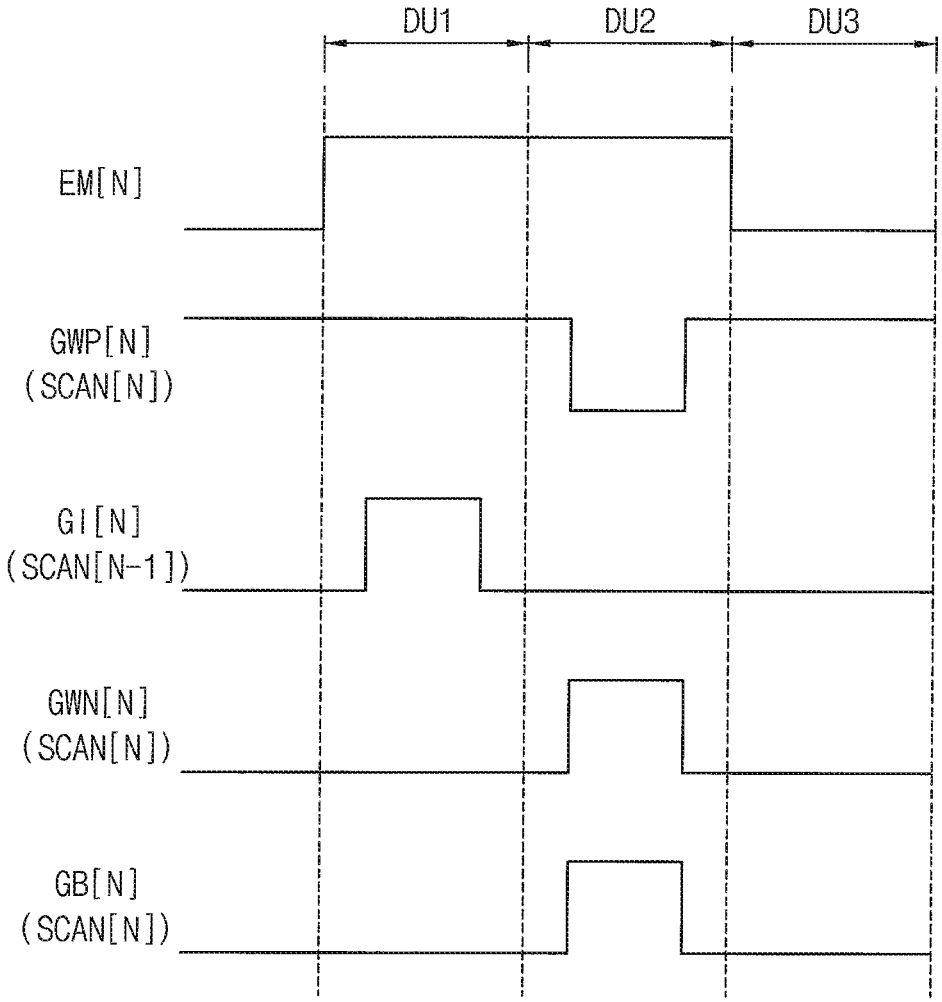
FIG. 17 is a timing diagram illustrating input signals applied to the pixel of FIG. 16.

FIG. 15 is a block diagram illustrating a display apparatus according to an example embodiment of the present disclosure. FIG. 16 is a circuit diagram illustrating a pixel of a display panel 100 of FIG. 15. FIG. 17 is a timing diagram illustrating input signals applied to the pixel of FIG. 16.

The display apparatus and the method of driving the display panel according to the present example embodiment is substantially the same as the display apparatus and the method of driving the display panel of the previous example embodiment explained referring to FIGS. 1 to 10 except for a structure of the display panel. Thus, the same reference numerals will be used to refer to the same or like parts as those described in the previous example embodiment of FIGS. 1 to 10 and any repetitive explanation concerning the above elements will be omitted.

Referring to FIGS. 2 to 10 and 15 to 17, the display apparatus includes the display panel 100 and a display panel driver. The display panel driver includes a driving controller 200, a gate driver 300, a gamma reference voltage generator 400, a data driver 500 and an emission driver 600.

The display panel 100 has a display region on which an image is displayed and a peripheral region adjacent to the display region.

The display panel 100 includes a plurality of gate lines GWPL, GWNL, GIL, and GBL, a plurality of data lines DL, a plurality of emission lines EL and a plurality of pixels electrically connected to the gate lines GWPL, GWNL, GIL, and GBL, the data lines DL, and the emission lines EL. The gate lines GWPL, GWNL, GIL, and GBL may extend in a first direction D1, the data lines DL may extend in a second direction D2 crossing the first direction D1 and the emission lines EL may extend in the first direction D1.

The driving controller 200 receives input image data IMG and an input control signal CONT from an external apparatus (not shown).

The driving controller 200 generates a first control signal CONT1, a second control signal CONT2, a third control signal CONT3, a fourth control signal CONT4, and a data signal DATA based on the input image data IMG and the input control signal CONT.

The emission driver 600 generates emission signals for driving the emission lines EL in response to the fourth control signal CONT4 received from the driving controller 200.

The emission driver 600 may output the emission signals to the emission lines EL.

The display panel 100 includes the plurality of the pixels. Each pixel includes an organic light emitting element OLED.

Each organic light emitting element OLED of the pixel receives a data write gate signal GWP and GWN, a data initialization gate signal GI, an organic light emitting element initialization signal GB, the data voltage VDATA, and the emission signal EM as input signals, and emits light corresponding to the level of the data voltage VDATA to display the image.

In the present example embodiment, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

For example, the data write gate signal may include a first data write gate signal GWP and a second data write gate signal GWN. The first data write gate signal GWP may be applied to the P-type transistor so that the first data write gate signal GWP has an activation signal of a low level corresponding to a data writing timing. The second data write gate signal GWN may be applied to the N-type transistor so that the second data write gate signal GWN has an activation signal of a high level corresponding to the data writing timing.

As depicted in FIG. 16, at least one of the pixels may include first to seventh pixel switching elements T1, T2, T3, T4, T5, T6, and T7, a storage capacitor CST, and an organic light emitting element OLED.

The first pixel switching element T1 includes a control electrode connected to a first node N1, an input electrode connected to a second node N2 and an output electrode connected to a third node N3.

For example, the first pixel switching element T1 may be the polysilicon thin film transistor. For example, the first pixel switching element T1 may be the P-type thin film transistor. The control electrode of the first pixel switching element T1 may be a gate electrode, the input electrode of the first pixel switching element T1 may be a source electrode, and the output electrode of the first pixel switching element T1 may be a drain electrode.

The second pixel switching element T2 includes a control electrode to which the first data write gate signal GWP is applied, an input electrode to which the data voltage VDATA is applied, and an output electrode connected to the second node N2.

For example, the second pixel switching element T2 may be the polysilicon thin film transistor. For example, the second pixel switching element T2 may be the P-type thin film transistor. The control electrode of the second pixel switching element T2 may be a gate electrode, the input electrode of the second pixel switching element T2 may be a source electrode and the output electrode of the second pixel switching element T2 may be a drain electrode.

The third pixel switching element T3 includes a control electrode to which the second data write gate signal GWN is applied, an input electrode connected to the first node N1, and an output electrode connected to the third node N3.

For example, the third pixel switching element T3 may be the oxide thin film transistor. For example, the third pixel switching element T3 may be the N-type thin film transistor. The control electrode of the third pixel switching element T3 may be a gate electrode, the input electrode of the third pixel switching element T3 may be a source electrode, and the output electrode of the third pixel switching element T3 may be a drain electrode.

The fourth pixel switching element T4 includes a control electrode to which the data initialization gate signal GI is applied, an input electrode to which an initialization voltage VI is applied, and an output electrode connected to the first node N1 and the third pixel switching element T3.

For example, the fourth pixel switching element T4 may be the oxide thin film transistor. For example, the fourth pixel switching element T4 may be the N-type thin film transistor. The control electrode of the fourth pixel switching element T4 may be a gate electrode, the input electrode of the fourth pixel switching element T4 may be a source electrode, and the output electrode of the fourth pixel switching element T4 may be a drain electrode.

The fifth pixel switching element T5 includes a control electrode to which the emission signal EM is applied, an input electrode to which a high power voltage ELVDD is applied, and an output electrode connected to the second node N2, the first pixel element T1, and the second pixel element T2.

For example, the fifth pixel switching element T5 may be the polysilicon thin film transistor. For example, the fifth pixel switching element T5 may be the P-type thin film transistor. The control electrode of the fifth pixel switching element T5 may be a gate electrode, the input electrode of the fifth pixel switching element T5 may be a source electrode, and the output electrode of the fifth pixel switching element T5 may be a drain electrode.

The sixth pixel switching element T6 includes a control electrode to which the emission signal EM is applied, an input electrode connected to the third node N3, the first pixel element T1, and the third pixel element T3, and an output electrode connected to an anode electrode of the organic light emitting element OLED.

For example, the sixth pixel switching element T6 may be the polysilicon thin film transistor. For example, the sixth pixel switching element T6 may be a P-type thin film transistor. The control electrode of the sixth pixel switching element T6 may be a gate electrode, the input electrode of the sixth pixel switching element T6 may be a source electrode, and the output electrode of the sixth pixel switching element T6 may be a drain electrode.

The seventh pixel switching element T7 includes a control electrode to which the organic light emitting element initialization gate signal GB is applied, an input electrode to which the initialization voltage VI is applied, and an output electrode connected to the anode electrode of the organic light emitting element OLED and the sixth pixel element T6.

For example, the seventh pixel switching element T7 may be the oxide thin film transistor. For example, the seventh pixel switching element T7 may be the N-type thin film transistor. The control electrode of the seventh pixel switching element T7 may be a gate electrode, the input electrode of the seventh pixel switching element T7 may be a source electrode, and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode connected to the output electrode of the sixth switching element T6 and a cathode electrode to which a low power voltage ELVSS is applied.

In FIG. 17, during a first duration DU1, the first node N1 and the storage capacitor CST are initialized in response to the data initialization gate signal GI. During a second duration DU2, a threshold voltage VTH of the first pixel switching element T1 is compensated and the data voltage VDATA of which the threshold voltage VTH is compensated is written to the first node N1 in response to the first and second data write gate signals GWP and GWN. In addition, during the second duration DU2, the anode electrode of the organic light emitting element OLED is initialized in response to the organic light emitting element initialization gate signal GB. During a third duration DU3, the organic light emitting element OLED emit the light in response to the emission signal EM so that the display panel 100 displays the image.

In the present example embodiment, some of the pixel switching elements may be designed using the oxide thin film transistors. In the present example embodiment, the third pixel switching element T3, the fourth pixel switching element T4, and the seventh pixel switching element T7 may be the oxide thin film transistors. The first pixel switching element T1, the second pixel switching element T2, the fifth pixel switching element T5, and the sixth pixel switching element T6 may be the polysilicon thin film transistors.

The display panel 100 may be driven in a normal driving mode in which the display panel 100 is driven in a normal driving frequency and in a low frequency driving mode in which the display panel 100 is driven in a frequency less than the normal driving frequency.

For example, when the input image data represent a video image, the display panel 100 may be driven in the normal driving mode. For example, when the input image data represent a still image, the display panel may be driven in the low frequency driving mode. For example, when the display apparatus is operated in the always on mode, the display panel may be driven in the low frequency driving mode.

The display panel 100 may be driven in a unit of frame. The display panel 100 may be refreshed in every frame in the normal driving mode. Thus, the normal driving mode includes only writing frames in which the data is written in the pixel.

The display panel 100 may be refreshed in the frequency of the low frequency driving mode in the low frequency driving mode. Thus, the low frequency driving mode includes the writing frames in which the data is written in the pixel and holding frames in which the written data is maintained without writing the data in the pixel.

For example, when the frequency of the normal driving mode is 60 Hz and the frequency of the low frequency driving mode is 1 Hz, the low frequency driving mode includes one writing frame and fifty nine holding frames in a second. For example, when the frequency of the normal driving mode is 60 Hz and the frequency of the low frequency driving mode is 1 Hz, fifty nine continuous holding frames are disposed between two adjacent writing frames.

For example, when the frequency of the normal driving mode is 60 Hz and the frequency of the low frequency driving mode is 10 Hz, the low frequency driving mode includes ten writing frame and fifty holding frames in a second. For example, when the frequency of the normal driving mode is 60 Hz and the frequency of the low frequency driving mode is 10 Hz, five continuous holding frames are disposed between two adjacent writing frames.

In the present example embodiment, the second data writing gate signal GWN and the data initialization gate signal GI may have a first frequency in the low frequency driving mode. The first frequency may be the frequency of the low frequency driving mode. In contrast, the first data writing gate signal GWP, the emission signal EM and the organic light emitting element initialization gate signal GB may have a second frequency greater than the first frequency. The second frequency may be the normal frequency of the normal driving mode.

The driving controller 200 in FIG. 2 may be applied to the structure of the display panel of the present example embodiment. In addition, the driving controller 200A in FIG. 12 may be applied to the structure of the display panel of the present example embodiment. In addition, the driving controller 200B in FIG. 13 may be applied to the structure of the display panel of the present example embodiment.

According to the present example embodiment, the driving frequency is determined according to the image displayed on the display panel 100 so that the power consumption of the display apparatus may be reduced. In addition, the driving frequency is determined using the flicker value of the image on the display panel 100 so that the flicker of the image may be prevented and the display quality of the display panel 100 may be enhanced. In addition, the flicker value storage 260 stores the flicker values not for all grayscale values, but for a part of grayscale values so that the flicker may be effectively prevented. Thus, the display quality of the display panel 100 may be enhanced.

As explained above, the power consumption of the display apparatus may be reduced and the display quality of the display panel may be enhanced.

The foregoing is illustrative of the present disclosure and is not to be construed as limiting. Although some example embodiments of the present disclosure have been described, those skilled in the art will readily appreciate that many modifications are possible in the example embodiments without materially departing from the novel teachings and advantages of the present disclosure. Accordingly, all such modifications are intended to be included within the scope of the present disclosure as defined in the claims. In the claims, means-plus-function clauses are intended to cover the structures described herein as performing the recited function and not only structural equivalents but also equivalent structures. Therefore, it is to be understood that the foregoing is illustrative of the present disclosure and is not to be construed as limited to the specific example embodiments disclosed, and that modifications to the disclosed example embodiments, as well as other example embodiments, are intended to be included within the scope of the appended claims. The present disclosure is defined by the following claims, with equivalents of the claims to be included therein.

What is claimed is:

1. A display apparatus comprising:

a display panel configured to display an image based on input image data provided from an external source;

a gate driver configured to output a gate signal to a gate line of the display panel;

a data driver configured to output a data voltage to a data line of the display panel; and a driving controller including a still image determiner module, a driving frequency determiner module, and flicker value storage module and configured to output a first control signal to the gate driver and to output a second control signal and a data signal to the data driver, wherein the still image determiner module determines whether the input image data is a still image or a video image to the driving frequency determiner module, and the driving frequency determiner module is configured to control an operation of the gate driver and an operation of the data driver, to selectively determine a driving mode of the display apparatus between a normal driving mode and a low frequency driving mode, wherein the flicker value storage module is configured to store flicker values for a part of grayscale values among all of grayscale values of the input image data, configured to set a first reference grayscale value, and configured to divide grayscale values equal to or less than the first reference grayscale value by a number of flicker setting stages, and configured to respectively store flicker values for a grayscale value divided by the number of the flicker setting stages, and the flicker values are configured to determine a driving frequency of the display panel based on the input image data, and wherein the driving frequency determiner module is configured to determine the driving frequency for grayscale values greater than the first reference grayscale value based on a flicker value of a last flicker setting stage among all of the flicker setting stages.

2. The display apparatus of claim 1, wherein the still image determiner module is configured to selectively determine whether the input image data provided from the external source is the still image or the video image, and configured to generate a flag representing whether the input image data is the still image or the video image, and the driving frequency determiner module is configured to selectively determine the driving mode of the display apparatus between the normal driving mode and the low frequency driving mode based on the flag from the still image determiner module to provide a data signal to the data driver, and configured to determine the driving frequency of the display panel by the flicker value storage module.

3. The display apparatus of claim 2, wherein when a minimum grayscale value of the input image data is 0, a maximum grayscale value of the input image data is 255, the number of flicker setting stages is 64, and the first reference grayscale value is 127, the flicker value storage module is configured to store a single flicker value for two grayscale values.

4. The display apparatus of claim 2, wherein when a minimum grayscale value of the input image data is 0, a maximum grayscale value of the input image data is 255, the number of flicker setting stages is 64, and the first reference grayscale value is 63, the flicker value storage module is configured to store a single flicker value for a single grayscale value.

5. The display apparatus of claim 1, wherein the flicker value storage module is configured to set a second reference grayscale value, configured to divide grayscale values equal to or greater than the second reference grayscale value by a number of flicker setting stages, and configured to respectively store flicker values for the grayscale values divided by the number of the flicker setting stages.

6. The display apparatus of claim 1, wherein the flicker value storage module is configured to set the first reference grayscale value and a second reference grayscale value, configured to divide grayscale values equal to or less than the first reference grayscale value and equal to or greater than the second reference grayscale value by a number of flicker setting stages, and configured to respectively store flicker values for the grayscale values divided by the number of the flicker setting stages.

7. The display apparatus of claim 6, wherein the driving frequency determiner module is configured to determine the driving frequency for grayscale values greater than the first reference grayscale value based on a flicker value of a last flicker setting stage among all of the flicker setting stages, and wherein the driving frequency determiner module is configured to determine the driving frequency for grayscale values less than the second reference grayscale value based on a flicker value of a first flicker setting stage among all of the flicker setting stages.

8. The display apparatus of claim 1, wherein the display panel includes a plurality of segments formed in a matrix, wherein the driving controller is configured to determine the driving frequency of the display panel based on optimal driving frequencies for the segments.

9. The display apparatus of claim 1, wherein the flicker value storage module is configured to store flicker values for a part of luminances among all of luminances of the input image data.

10. A display apparatus comprising:

a display panel configured to display an image based on input image data provided from an external source;

a gate driver configured to output a gate signal to a gate line of the display panel;

a data driver configured to output a data voltage to a data line of the display panel; and a driving controller including a still image determiner module and a driving frequency determiner module configured to control an operation of the gate driver and an operation of the data driver, to selectively determine a driving mode of the display apparatus between a normal driving mode and a low frequency driving mode, wherein the driving controller comprises a flicker value storage module configured to store flicker values for a part of grayscale values among all of grayscale values of the input image data, and the flicker values are configured to determine a driving frequency of the display panel based on the input image data, wherein the flicker value storage module is configured to set a second reference grayscale value, configured to divide grayscale values equal to or greater than the second reference grayscale value by a number of flicker setting stages, and configured to respectively store flicker values for the grayscale values divided by the number of the flicker setting stages, and wherein the driving frequency determiner module is configured to determine the driving frequency for grayscale values less than the second reference grayscale value based on a flicker value of a first flicker setting stage among all of the flicker setting stages.

11. A method of driving a display panel, the method comprising steps of:

determining a driving mode of a display apparatus between a normal driving mode and a low frequency driving mode based on input image data provided from an external source;

determining a driving frequency of the display panel by a flicker value storage module configured to store flicker values for a part of grayscale values among all of grayscale values of the input image data, wherein the flicker values are configured to determine a driving frequency of the display panel based on the input image data;

outputting a gate signal to a gate line of the display panel based on the driving frequency; and outputting a data voltage to a data line of the display panel based on the driving frequency, wherein the flicker value storage module is configured to set a first reference grayscale value and configured to divide grayscale values equal to or less than the first reference grayscale value by a number of flicker setting stages, and configured to respectively store flicker values for a grayscale value divided by the number of the flicker setting stages, and wherein the determining the driving frequency further comprises a step of determining the driving frequency for grayscale values greater than the first reference grayscale value based on a flicker value of a last flicker setting stage among all of the flicker setting stages.

12. The method of claim 11, wherein the determining the driving frequency comprises steps of:

determining whether the input image data is a still image or a video image;

generating a flag representing whether the input image data is the still image or the video image;

determining the driving mode of the display apparatus between the normal driving mode and the low frequency driving mode based on the flag; and determining the driving frequency of the display panel by the flicker value storage.

13. The method of claim 11, wherein the flicker value storage module is configured to set a second reference grayscale value, configured to divide grayscale values equal to or greater than the second reference grayscale value by a number of flicker setting stages, and configured to respectively store flicker values for the grayscale values divided by the number of the flicker setting stages.

14. The method of claim 13, wherein the determining the driving frequency further comprises a step of determining the driving frequency for grayscale values less than the second reference grayscale value based on a flicker value of a first flicker setting stage among all of the flicker setting stages.

15. The method of claim 11, wherein the flicker value storage module is configured to set the first reference grayscale value and a second reference grayscale value, configured to divide grayscale values equal to or less than the first reference grayscale value and equal to or greater than the second reference grayscale value by a number of flicker setting stages, and configured to respectively store flicker values for the grayscale values divided by the number of the flicker setting stages.

16. The method of claim 15, wherein the determining the driving frequency further comprises a step of determining the driving frequency for grayscale values greater than the first reference grayscale value based on a flicker value of a last flicker setting stage among all of the flicker setting stages, and wherein the determining the driving frequency further comprises a step of determining the driving frequency for grayscale values less than the second reference grayscale value based on a flicker value of a first flicker setting stage among all of the flicker setting stages.

* * * * *